US010163277B2

(12) United States Patent
Light-Holets

(10) Patent No.: US 10,163,277 B2
(45) Date of Patent: Dec. 25, 2018

(54) IDLE ENGINE OPERATION BASED ON VEHICLE CABIN TEMPERATURE

(71) Applicant: CUMMINS INC., Columbus, IN (US)

(72) Inventor: Jennifer K. Light-Holets, Greenwood, IN (US)

(73) Assignee: CUMMINS INC., Columbus, IN (US)

( * ) Notice: Subject to any disclaimer, the term of this patent is extended or adjusted under 35 U.S.C. 154(b) by 71 days.

(21) Appl. No.: 15/280,441

(22) Filed: Sep. 29, 2016

(65) Prior Publication Data

US 2017/0101952 A1 Apr. 13, 2017

Related U.S. Application Data

(60) Provisional application No. 62/238,972, filed on Oct. 8, 2015.

(51) Int. Cl.

| | |
|---|---|
| ***F02D 41/06*** | (2006.01) |
| ***G07C 5/08*** | (2006.01) |
| ***F02D 41/08*** | (2006.01) |
| ***F02N 11/08*** | (2006.01) |

(52) U.S. Cl.

CPC ..... *G07C 5/08* (2013.01); *F02D 41/08* (2013.01); *F02N 11/0803* (2013.01); *F02N 2200/061* (2013.01); *F02N 2200/08* (2013.01); *F02N 2200/0804* (2013.01); *F02N 2200/122* (2013.01)

(58) Field of Classification Search

CPC ..... G07C 5/08; F02D 41/08; F02N 11/0803; F02N 2200/061; F02N 2200/08; F02N 2200/0804; F02N 2200/122

USPC ..... 701/112

See application file for complete search history.

(56) References Cited

U.S. PATENT DOCUMENTS

| | | | | |
|---|---|---|---|---|
| 4,286,683 | A | 9/1981 | Zeigner et al. | |
| 5,072,703 | A | 12/1991 | Sutton | |
| 5,317,998 | A | 6/1994 | Hanson et al. | |
| 6,836,718 | B2 | 12/2004 | Hasfjord et al. | |
| 7,027,912 | B1 | 4/2006 | Metzger | |
| 7,091,629 | B2 | 8/2006 | Hawkins | |
| 7,171,300 | B1 * | 1/2007 | Anderson | F02D 41/042 701/112 |
| 2004/0060282 | A1 * | 4/2004 | Hirooka | F01N 3/22 60/278 |
| 2004/0262995 | A1 * | 12/2004 | Hawkins | F02N 11/0803 307/10.6 |
| 2005/0225175 | A1 * | 10/2005 | Maehara | B60W 10/06 307/10.1 |
| 2006/0275145 | A1 * | 12/2006 | Takahashi | B60H 1/3216 417/222.2 |

(Continued)

FOREIGN PATENT DOCUMENTS

| | | |
|---|---|---|
| JP | H1144230 | 2/1999 |

*Primary Examiner* — David Hamaoui
*Assistant Examiner* — Susan Scharpf
(74) *Attorney, Agent, or Firm* — Faegre Baker Daniels LLP

(57) ABSTRACT

A method for operating an engine based on cabin temperature includes determining a quantity of fuel in a fuel tank, determining a minimum amount of fuel to remain in the fuel tank, receiving a predetermined cabin temperature value, calculating an engine idle time in response to the minimum amount of fuel and the predetermined cabin temperature value, and controlling engine starting and stopping in response to the engine idle time and the predetermined cabin temperature value.

23 Claims, 2 Drawing Sheets

(56) References Cited

U.S. PATENT DOCUMENTS

2010/0072290 A1* 3/2010 Dage ..... B60H 1/00657 236/51
2011/0035137 A1* 2/2011 Konishi ..... F02N 11/0818 701/115
2011/0048044 A1* 3/2011 Aoyagi ..... B60H 1/00764 62/133
2011/0163721 A1* 7/2011 Van Wiemeersch ..... B60R 16/033 320/128
2011/0246013 A1* 10/2011 Yee ..... B60L 11/1859 701/22
2012/0179329 A1* 7/2012 Okamoto ..... B60H 1/00735 701/36
2012/0202413 A1* 8/2012 Kawashima ..... B60H 1/00285 454/75
2012/0286052 A1* 11/2012 Atluri ..... B60K 16/00 237/28
2012/0296549 A1* 11/2012 Adams ..... G07C 5/008 701/102
2013/0035788 A1* 2/2013 Divelbiss ..... B67D 7/04 700/244
2013/0066525 A1* 3/2013 Tomik ..... B60K 28/04 701/45
2014/0110489 A1* 4/2014 Yasui ..... F02N 11/0833 237/5
2014/0371951 A1* 12/2014 Michael ..... F02N 11/0807 701/2
2014/0371983 A1* 12/2014 Miyashita ..... B60L 1/003 701/36
2015/0027406 A1* 1/2015 Cooper ..... F02D 41/2477 123/364
2015/0129192 A1* 5/2015 Boss ..... B60H 1/00878 165/202
2015/0210284 A1* 7/2015 Miyashita ..... B60W 40/04 701/117
2015/0274153 A1* 10/2015 Kanai ..... F02D 41/0025 477/3

* cited by examiner

IDLE ENGINE OPERATION BASED ON VEHICLE CABIN TEMPERATURE

CROSS-REFERENCE TO RELATED APPLICATIONS

The present application claims priority to U.S. Provisional Patent Application Ser. No. 62/238,972, filed Oct. 8, 2015, and entitled "IDLE ENGINE OPERATION BASED ON VEHICLE CABIN TEMPERATURE," the complete disclosure of which is expressly incorporated by reference herein.

TECHNICAL FIELD

The present disclosure relates generally to managing operation of an idling engine and, more particularly, to managing operation of an engine at idle in response to at least one vehicle parameter.

BACKGROUND OF THE DISCLOSURE

Cargo vehicles, for example, semi-trucks or trailers, may include a cabin portion for the operator to rest or sleep during a long trip. The cabin may be equipped with heat, air conditioning, electricity, or other features to increase the operator's comfort when in the cabin. To operate the heat, air conditioning, and/or electrical components of the cabin, the engine of the vehicle operates at idle when the vehicle is stopped or may be started and stopped to reduce the time spent at idle.

However, while the engine is idling when the operator is in the cabin of the vehicle, the quantity of fuel and/or other vehicle fluids (e.g., a reductant) decreases. Depending on the length of time that the engine idles while the operator sleeps, rests, or is otherwise not operating the vehicle, the quantity of fuel and/or other fluids may decrease below a predetermined level. More particularly, if, while the engine is idling to maintain the heat, air conditioning, and/or electrical components within the vehicle cabin, the vehicle fluids decrease below a predetermined quantity, the operator may have insufficient vehicle fluids to travel to the next service/fuel station to replenish the fluids. Therefore, it is necessary to monitor the vehicle fluids when the engine is idling and to manage the engine operation when the vehicle is not moving to maintain sufficient quantities of the vehicle fluids.

SUMMARY OF THE DISCLOSURE

In one embodiment of the present disclosure, a method includes determining a quantity of fuel in a fuel tank, determining a minimum amount of fuel to remain in the fuel tank, receiving a predetermined cabin temperature value, calculating an engine idle time in response to the minimum amount of fuel and the predetermined cabin temperature value, and controlling engine starting and stopping in response to the engine idle time and the predetermined cabin temperature value.

In another embodiment of the present disclosure, a method comprises determining a quantity of fuel in a fuel tank, determining a minimum amount of fuel to remain in the fuel tank, determining a quantity of reductant on a vehicle, receiving a predetermined cabin temperature value, calculating an engine idle time in response to at least one of the minimum amount of fuel, the quantity of reductant, and the predetermined cabin temperature value, and controlling engine starting and stopping in response to the engine idle time and the predetermined cabin temperature value.

In a further embodiment of the present disclosure, an engine control assembly comprises a fuel sensor configured to determine a fuel level, a fluid sensor configured to determine a quantity of reductant on a vehicle, a temperature sensor configured to determine a temperature in a cabin of a vehicle, and a controller operably coupled to the fuel sensor, fluid sensor, and temperature sensor. The controller is configured to operate an engine in response to the fuel level and the quantity of reductant to maintain the temperature in the cabin.

In another embodiment of the present disclosure, a method includes determining a quantity of reductant, and calculating the engine idle time and controlling engine starting and stopping is in response to the quantity of reductant.

In a further embodiment of the present disclosure, a method includes receiving a distance to a fueling station value before calculating the engine idle time, and controlling engine starting and stopping is in response to the distance to the fueling station value.

In another embodiment of the present disclosure, a method includes receiving an ambient conditions value before calculating the engine idle time, and controlling engine starting and stopping is in response to the ambient conditions value.

In a further embodiment of the present disclosure, a method includes determining an engaged status of a park brake, and calculating the engine idle time and/or determining a transmission gear position before calculating the engine idle time.

In another embodiment of the present disclosure, a method includes subtracting the minimum amount of fuel from the amount of fuel in the fuel tank, and calculating the engine idle time in response to a remaining amount of fuel in the fuel tank.

In a further embodiment of the present disclosure, a method includes outputting a time value of the engine idle time available at the predetermined cabin temperature value.

In another embodiment of the present disclosure, a method includes calculating a second engine idle time in response to refilling the fuel tank.

In a further embodiment of the present disclosure, a method includes operating the engine when the amount of fuel in the fuel tank is less than an amount of fuel required to fill the fuel tank.

In another embodiment of the present disclosure, an engine control assembly includes a controller configured to determine an engine idle time in response to the fuel level, the quantity of reductant, and the temperature in the cabin.

In a further embodiment of the present disclosure, an engine control assembly includes at least one position sensor operably coupled to the controller and configured to determine at least one of a transmission gear position and a position of a park brake of the vehicle, and the controller is configured to operate the engine in response to the at least one of the transmission gear position and the position of the park brake.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
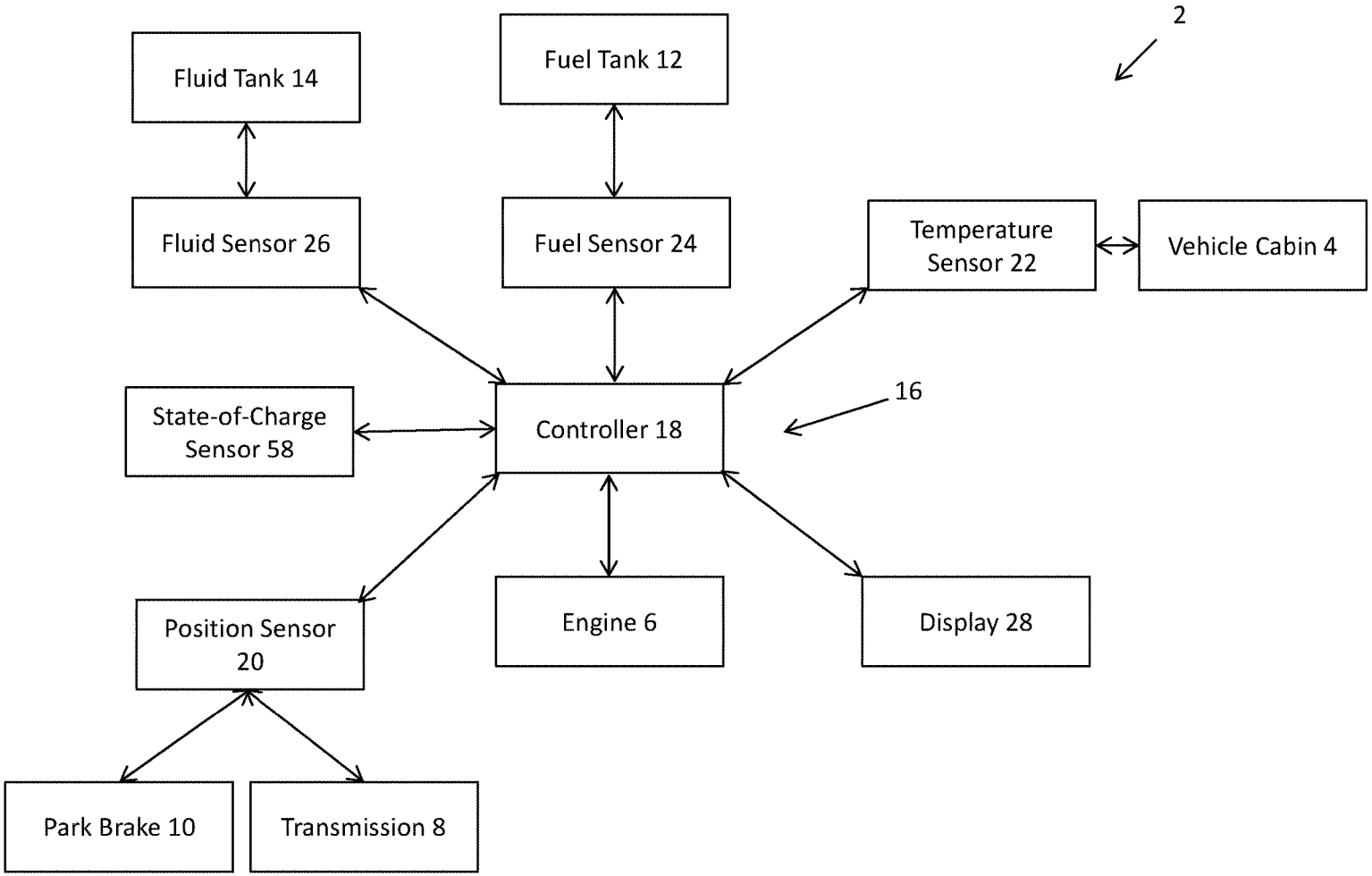
FIG. 1 is a diagrammatic view of a vehicle.

Although the drawings represent embodiments of the various features and components according to the present disclosure, the drawings are not necessarily to scale and certain features may be exaggerated in order to better illustrate and explain the present disclosure. The exemplification set out herein illustrates embodiments of the disclosure, and such exemplifications are not to be construed as limiting the scope of the disclosure in any manner.

DETAILED DESCRIPTION OF THE DRAWINGS

For the purpose of promoting an understanding of the principles of the disclosure, reference will now be made to the embodiments illustrated in the drawings, which are described below. It will nevertheless be understood that no limitation of the scope of the disclosure is thereby intended. The disclosure includes any alterations and further modifications in the illustrated device and described methods and further applications of the principles of the disclosure, which would normally occur to one skilled in the art to which the disclosure relates. Moreover, the embodiments were selected for description to enable one of ordinary skill in the art to practice the disclosure.

Referring to FIG. 1, a vehicle 2 may include a trailer or cargo area (not shown) and a vehicle cabin 4 for the operator. Vehicle 2 may be a semi-truck or any other type of vehicle configured to support and transport the operator and cargo. Vehicle cabin 4 may define sleeping or resting quarters for the operator and, as such, may include air vents, electrical components (e.g., lights), a bed, and a storage area for personal items. In this way, the operator may have access to heat, air conditioning, and electricity when in vehicle cabin 4 to provide the operator with some "creature comforts" during a trip to transport cargo.

Referring still to FIG. 1, vehicle 2 also includes an engine 6, a transmission 8 operably coupled to engine 6, a park brake 10 operably coupled to transmission 8, a fuel tank 12 fluidly coupled to engine 6, and at least one fluid container or tank 14 fluidly coupled to engine 6 and/or transmission 8. For example, fluid tank 14 may contain any vehicle fluid, such as a reductant (e.g., diesel exhaust fluid ("DEF")). When engine 6 is operating, all systems within vehicle cabin 4 may be operational, such as electrical components (e.g., lights, radio), air vents for heat and/or air conditioning, etc.

As shown in FIG. 1, vehicle 2 also includes a control system 16 configured to monitor and/or manage operation of vehicle 2 and engine 6 when vehicle 2 is both moving and not moving (e.g., when engine 6 is idling). In one embodiment, and as disclosed further herein, control system 16 is configured to manage operation of engine 6 when idling to ensure that sufficient quantities of fuel and/or vehicle fluid are maintained for proper use of vehicle 2 after idling. Illustrative control system 16 includes at least a controller 18, a position sensor 20 operably coupled to controller 18, transmission 8, and/or park brake 10, a temperature sensor 22 operably coupled to controller 18 and at least vehicle cabin 4, a fuel sensor 24 operably coupled to controller 18 and fuel tank 12, a fluid sensor 26 operably coupled to controller 18 and fluid tank 14, and at least one display 28 operably coupled to controller 18. In this way, controller 18, either directly or through a plurality of sensors, is operably coupled to vehicle cabin 4, engine 6, transmission 8, park brake 10, fuel tank 12, and fluid tank 14.

When vehicle 2 is moving, engine 6 operates to move vehicle 2 down the road and control system 16 indicates to the operator at least the position or gear of transmission 8 and park brake 10, the quantity of fuel within fuel tank 12, and the quantity of fluid within fluid tank 14. Because the operator is operating vehicle 2 when vehicle 2 is moving, the operator is aware of the quantity of fuel and fluid within tanks 12 and 14, respectively, and is able to determine when the fuel and fluids should be replenished for continued operation of vehicle 2.

However, when vehicle 2 is not moving and the operator is within vehicle cabin 4 to rest or sleep, engine 6 may continue to operate to provide the operator with various "creature comforts" while in vehicle cabin 4. For example, engine 6 may continue to operate while vehicle 2 idles to provide heat, air conditioning, and/or electricity to vehicle cabin 4. Because the operator may be sleeping and, therefore, is no longer monitoring the quantity of fuel and/or fluid being used to operate engine 6 when idling, control system 16 monitors the quantity of fuel and/or fluid and manage operation of engine 6 when idling and while the operator sleeps/rests.

Figure 2:
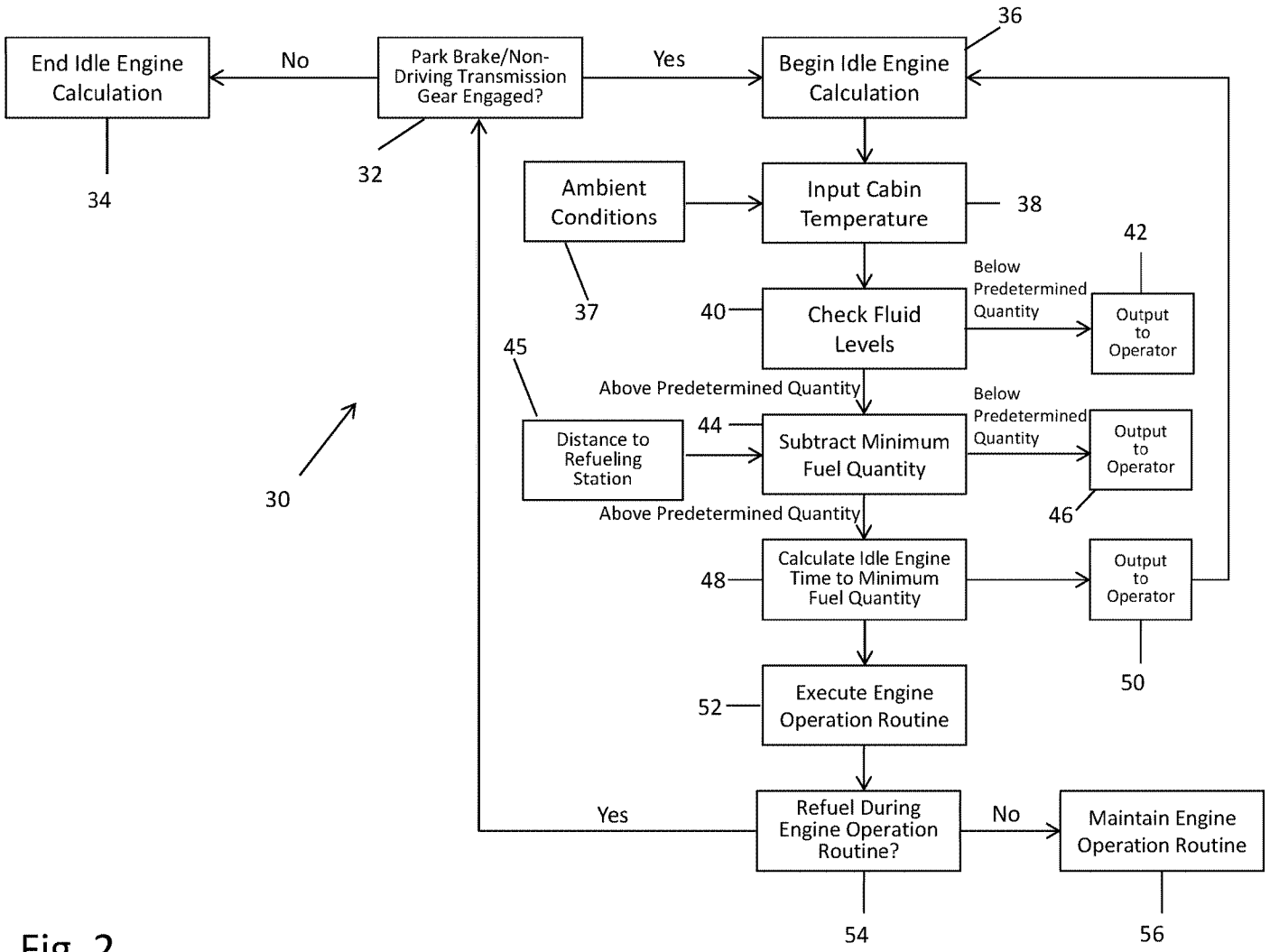
FIG. 2 is a flow chart for calculating an engine idle time and managing operation of the vehicle of FIG. 1.

More particularly, and referring to FIG. 2, control system 16 (FIG. 1) performs a method 30 to manage operation of engine 6 when idling. For example, in one embodiment, control system 16 initiates method 30 by determining if park brake 10 is engaged and/or if transmission 8 is in non-driving gear (e.g., neutral) in Step 32 of method 30. In one embodiment, Step 32 is performed when controller 18 transmits a signal to position sensor 20 to determine if park brake 10 is engaged and/or if transmission 8 is in non-driving gear. Position sensor 20 then determines the status of park brake 10 and/or transmission 8 and transmits a signal to controller 18 indicative of the status of park brake 10 and/or transmission 8. If controller 18 receives a signal from position sensor 20 that park brake 10 is not engaged and/or that transmission 8 is not in a non-driving gear, then method 30 does not perform an idle engine calculation, as shown in Step 34. As such, method 30 is not completed if park brake 10 of vehicle 2 is not engaged or if transmission 8 of vehicle 2 is in a driving gear (e.g., first gear, second gear, third gear, fourth gear, fifth gear, overdrive, high gear(s), low gear(s), or reverse).

Alternatively, in one embodiment of method 30, at Step 32, controller 18 also may determine if a hood switch (not shown) for vehicle 2 is engaged. If the hood switch is not engaged, it may indicate that the hood (not shown) of vehicle 2 is open because someone is working on vehicle 2 and, more particularly, repairing or evaluating engine 6. As such, if the hood switch is not engaged, then the idle engine calculation also ends, as shown in Step 34.

If, however, controller 18 receives a signal from position sensor 20 that park brake 10 is engaged, transmission 8 is in a non-driving gear, and/or the hood switch of vehicle 2 is engaged, then method 30 proceeds with the idle engine calculation, as shown in Step 36 of FIG. 2. To proceed with the idle engine calculation, a temperature input for vehicle cabin 4 is transmitted to controller 18 in Step 38. More particularly, Step 38 may be performed by prompting the operator through a message on display 28 to enter a predetermined or desired temperature for vehicle cabin 4 while engine 6 idles. Alternatively, Step 38 may be performed by using a previously input temperature from the operator for the temperature of vehicle cabin 4. The temperature of vehicle cabin 4 is monitored and maintained by temperature sensor 22 which transmits temperature signals to controller 18.

Additionally, and referring still to FIG. 2, temperature sensor 22 or another sensor or device (not shown) may be used to determine ambient air conditions in Step 37. For example, temperature sensor 22 may be configured to determine or measure the ambient temperature, humidity, dew point, etc. The ambient air conditions may be transmitted to the controller 18, either automatically when vehicle 2 is parked or after controller 18 transmits a signal to temperature sensor 22 to determine the ambient air conditions.

Once a temperature for vehicle cabin 4 and/or the ambient air conditions are transmitted to controller 18 in Steps 38 and 37, respectively, method 30 continues and controller 18 sends a signal to fuel sensor 24 and fluid sensor 26 to check the quantity of fuel in fuel tank 12 and the quantity of vehicle fluid (e.g., DEF) in fluid tank 14, respectively, in Step 40. As shown in FIG. 2, if the signals received by controller 18 from fuel sensor 24 and fluid sensor 26 indicate that a quantity of fuel and/or vehicle fluid is below a predetermined quantity, controller 18 transmits a signal to display 28 to alert the operator that engine 6 should not operate while vehicle 2 is parked. More particularly, in Step 42, control system 16 alerts the operator through display 28 that there is an insufficient quantity of fuel and/or vehicle fluid to allow engine 6 to idle when vehicle 2 is not moving. As such, the operator knows that, while in vehicle cabin 4, he/she will not be able to control the temperature or use electricity because of an insufficient quantity of fuel and/or vehicle fluid to maintain prolonged use of engine 6 while the operator rests/sleeps. At that time, the operator may choose to refuel and/or replenish the supply of vehicle fluid(s) or may choose to forego heat, air conditioning, and electricity while in vehicle cabin 4.

However, if the signals received by controller 18 from fuel sensor 24 and fluid sensor 26 indicate that the quantities of fuel and vehicle fluid are above the predetermined quantity, control system 16 proceeds with the idle engine calculation and initiates Step 44.

In Step 44 of FIG. 2, a predetermined minimum quantity of fuel is subtracted from the measured quantity of fuel in fuel tank 12 by fuel sensor 24 and a predetermined minimum quantity of vehicle fluid is subtracted from the measured quantity of vehicle fluid in fluid tank 14 by fluid sensor 26. The minimum quantity of fuel and vehicle fluid may be input by the operator, depending on various factors, such as the distance to the closest refueling station, which the operator may input in Step 45. Alternatively, a GPS device (not shown) of vehicle 2 may calculate the distance to the closest refueling station and transmit that information to controller 18, in Step 45. In one embodiment, the operator may automatically enter the minimum quantities of fuel and fluid before or while engine 6 idles or may input the minimum quantities of fuel and fluid in response to a prompt on display 28 from controller 18. Alternatively, the manufacturer of vehicle 2 and/or engine 6 may set the minimum quantity of fuel and vehicle fluid. As such, the predetermined minimum quantity of fuel and fluid is meant to be maintained within fuel tank 12 and fluid tank 14, respectively, to ensure sufficient quantities of fuel and fluid to allow vehicle 2 to travel to the next fueling station after the operator rests/sleeps in vehicle cabin 4.

If, when the minimum quantity of fuel is subtracted from the measured quantity of fuel in fuel tank 12 and the minimum quantity of vehicle fluid is subtracted from the measured quantity of fluid in fluid tank 14, the remaining quantity of fuel and/or fluid is below the predetermined threshold quantities input by the operator or the manufacturer (see Step 40), controller 18 transmits a signal to display 28 to alert the operator that engine 6 should not operate while vehicle 2 is parked. More particularly, in Step 46, control system 16 alerts the operator through display 28 that there would be an insufficient quantity of fuel and/or vehicle fluid to allow engine 6 to idle when vehicle 2 is parked after subtracting the minimum quantities of fuel and fluid. As such, the operator knows that while in vehicle cabin 4, he/she will not be able to control the temperature or use electricity when in vehicle cabin 4 because of an insufficient quantity of fuel and/or vehicle fluid to maintain prolonged use of engine 6 while the operator rests/sleeps. At that time, the operator may choose to refuel and/or replenish the supply of vehicle fluid(s) or may choose to forego heat, air conditioning, and electricity while in vehicle cabin 4. Alternatively, control system 16 may suggest an option to the operator to decrease the temperature desired in vehicle cabin 4 while vehicle 2 idles which may allow engine 6 to idle for at least a period of time when the operator is within vehicle cabin 4 before the minimum quantities of fuel and/or vehicle fluid would be reached.

However, if, when the minimum quantity of fuel is subtracted from the measured quantity of fuel in fuel tank 12 and the minimum quantity of vehicle fluid is subtracted from the measured quantity of fluid in fluid tank 14, the remaining quantity of fuel and/or fluid is above the predetermined quantities input by the operator or the manufacturer (see Step 40), control system 16 proceeds with the idle engine calculation and initiates Step 48.

In Step 48 of FIG. 2, control system 16 proceeds with the idle engine calculation to determine the time engine 6 may idle based on at least the desired temperature for the operator when in vehicle cabin 4, the quantity of fuel in fuel tank 12, and the quantity of vehicle fluid in fluid tank 14. In one embodiment, after Step 48 of method 30 calculates the idle engine time, controller 18 may transmit an output signal to display 28 to output the idle engine time to the operator in Step 50. If the operator knows that vehicle 2 will remain parked for longer than the idle engine time, the operator may choose to decrease the desired temperature for vehicle cabin 4 and/or proceed to the closest refueling station to increase the idle engine time. After the operator chooses to decrease the temperature in vehicle cabin 4 and/or refuel, the idle engine calculation will begin again. Alternatively, control system 16 may not indicate the idle engine time to the operator and, instead, automatically control operation of engine 6 in response to the desired temperature for vehicle cabin 4, the quantity of fuel, and the quantity of vehicle fluids.

With the idle engine time calculated, Step 52 of FIG. 2 executes an engine operation routine in response to the idle engine time. More particularly, control system 16 controls operation of engine 6 when idling to monitor and maintain operation of engine 6 while still providing "creature comforts" (e.g., heat, air conditioning, and/or electricity) to vehicle cabin 4. For example, control system 16 may allow engine 6 to operate continuously for the engine idle time calculated to provide continuous heat, air, and electricity to vehicle cabin 4. However, if vehicle 2 is still parked after the idle engine time has been exceeded, then control system 16 is configured to terminate operation of engine 6 to maintain the fuel and fluid levels above the predetermined quantities. As such, heat, air, and electricity would no longer be provided to vehicle cabin 4 when engine 6 does not operate.

Alternatively, control system 16 may be configured to periodically cycle the operation of engine 6 over the idle engine time calculated in Step 48. For example, to periodically provide heat, air, and electricity to vehicle cabin 4, control system 16 may allow engine 6 to operate for a shortened period of time (i.e., a period of time less than the calculated idle engine time) before temporarily terminating operation of engine 6. After a period of time in which engine 6 is not operating, control system 16 may be configured to re-start engine 6 for another shortened period of time before again temporarily terminating operation of engine 6. Control system 16 may periodically start and stop operation of engine 6 over the course of the idle engine time to periodically provide at least heat, air, and electricity to vehicle cabin 4 when vehicle 2 is parked.

If, during the engine operation routine performed by control system 16 in response to the idle engine time, the operator refuels vehicle 2 such that the quantity of fuel and/or vehicle fluids increases during the engine operation routine, as shown in Step 54 of FIG. 2, control system 16 is configured to provide a check for this. For example, if no refueling occurs, then the engine operation routine is maintained, as shown in Step 56. Conversely, if refueling occurs, then the idle engine calculation re-starts, by initiating Step 32 of method 30 again. In this way, a second idle engine time may be calculated in response to refueling.

Additionally, if vehicle 2 is parked while the operator is operating vehicle 2, for example, during a traffic jam, method 30 may calculate the idle engine time. However, after the parked condition is over (e.g., traffic starts to move again) and when the operator wishes to park vehicle 2 to rest or sleep, method 30 starts over to provide an accurate and up-to-date idle engine time to the operator.

It may be appreciated that the predetermined quantity of fuel and vehicle fluid may be any quantity between 0-100% of fluid within tanks 12, 14. As such, method 30 is configured to proceed with the engine operation routine when the quantity of fuel in fuel tank 12 and/or vehicle fluid in fluid tank 14 is less than 100%. In this way, engine 6 is allowed to idle for a predetermined period of time when the quantity of fuel in fuel tank 12 and/or vehicle fluid in fluid tank 14 is less than 100%.

In one embodiment, the manufacturer of engine 6 and/or vehicle 2 may set the predetermined quantity of fuel and vehicle fluid before use by the operator. Alternatively, the operator, either in advance of operating vehicle 2 or when vehicle 2 is parked/idling, may set the predetermined quantity of fuel and vehicle fluid. For example, the operator may automatically enter the minimum quantities of fuel and vehicle fluid he/she desires to maintain within tanks 12, 14 and/or may input the desired minimum quantities of fuel and vehicle fluid in response to an output on display 28 via controller 18. By allowing the operator to input and change the predetermined quantities of fuel and vehicle fluid, the operator can take into account the distance to the next refueling station, unique parameters of vehicle 2, and/or unique circumstances of the trip the operator is making, etc. Because these factors may change from day-to-day while the operator is operating vehicle 2, the operator can adjust these minimum threshold quantities of fuel and vehicle fluid in response to varying factors (e.g., distance to a refueling station).

While the engine operation routine is executed, control system 16 is configured to monitor and maintain the desired temperature in vehicle cabin 4 to provide "creature comforts" to the operator while he/she rests or sleeps. Additionally, control system 16 may be configured to monitor and manage the state-of-charge of a battery of vehicle 2, the temperature of engine 6, and/or any other parameter of vehicle 2 when engine 6 idles. For example, to maintain operation of any electrical components in vehicle cabin 4, control system 16 includes a state-of-charge sensor 58 operably coupled to the battery (not shown) of vehicle 2 and controller 18. During execution of method 30, controller 18 may receive an input indicative of a target state-of-charge value for the battery to maintain sufficient charge in the battery when vehicle 2 begins to move again. Additionally, controller 18 also may receive a signal from state-of-charge sensor 58 indicative of the actual value of the state-of-charge of the battery. The actual and target state-of-charge values may affect the calculation of the engine idle time and the management of the operation of engine 6 at idle. In this way, method 30 also may proceed in response to a plurality of parameters of vehicle 2 and engine 6, including the state-of-charge output, temperature of engine 6, or any other parameter of vehicle 2.

While the embodiments have been described as having exemplary designs, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this invention pertains.

The invention claimed is:

1. A method, comprising:

determining a quantity of fuel in a fuel tank;

determining a minimum amount of fuel to remain in the fuel tank;

receiving a target cabin temperature value;

calculating an engine idle time available during which an engine is operable at idle based on the minimum amount of fuel; and controlling engine starting and stopping in response to the engine idle time available and the cabin temperature value.

2. The method of claim 1, further comprising determining a quantity of reductant, receiving a value indicative of a minimum amount of reductant to remain, calculating the engine idle time available in response to the minimum amounts of fuel and reductant, and controlling engine starting and stopping is in response to the quantities of reductant and fuel.

3. The method of claim 1, further comprising receiving a distance to a fueling station value, and calculating the engine idle time available and controlling engine starting and stopping is in response to the distance to the fueling station value.

4. The method of claim 3, further comprising adjusting the minimum amount of fuel to remain in the fuel tank in response to the distance to the fueling station value.

5. The method of claim 1, further comprising receiving an ambient conditions value, and calculating the engine idle time available and controlling engine starting and stopping is in response to the ambient conditions value.

6. The method of claim 5, further comprising adjusting the minimum amount of fuel to remain in the fuel tank in response to the ambient conditions value.

7. The method of claim 1, further comprising determining an engaged status of a park brake, and calculating the engine idle time available is in response to the status of the park brake.

8. The method of claim 1, further comprising determining a transmission gear position, and calculating the engine idle time available is in response to the transmission gear position.

9. The method of claim 1, further comprising subtracting the minimum amount of fuel from the amount of fuel in the fuel tank, and calculating the engine idle time available is in response to a remaining amount of fuel in the fuel tank.

10. The method of claim 1, further comprising outputting a time value of the engine idle time available at the predetermined cabin temperature value.

11. The method of claim 1, further comprising calculating a second engine idle time in response to refilling the fuel tank.

12. The method of claim 1, further comprising operating the engine when the amount of fuel in the fuel tank is less than an amount of fuel required to fill the fuel tank.

13. The method of claim 1, further comprising:

receiving a state-of-charge target value of a battery;

determining an actual state-of-charge value of the battery; and controlling engine starting and stopping in response to the state-of-charge target value and the actual state-of-charge value.

14. A method, comprising:

determining a quantity of fuel in a fuel tank;

determining a minimum amount of fuel to remain in the fuel tank;

determining a quantity of reductant on a vehicle;

receiving a predetermined cabin temperature value;

calculating an engine idle time during which an engine is operable at idle based on at least one of: the minimum amount of fuel, the quantity of reductant, and the predetermined cabin temperature value; and controlling engine starting and stopping in response to the engine idle time and the predetermined cabin temperature value.

15. The method of claim 14, further comprising receiving a distance to a fueling station value, and calculating the engine idle time and controlling engine starting and stopping is in response to the distance to the fueling station value.

16. The method of claim 14, further comprising receiving an ambient conditions value, and calculating the engine idle time and controlling engine starting and stopping is in response to the ambient conditions value.

17. The method of claim 14, further comprising determining an engaged status of a park brake, and calculating the engine idle time is in response to the status of the park brake.

18. The method of claim 14, further comprising determining a transmission gear position, and calculating the engine idle time is in response to the transmission gear position.

19. The method of claim 14, further comprising subtracting the minimum amount of fuel from the amount of fuel in the fuel tank, and calculating the engine idle time is in response to a remaining amount of fuel in the fuel tank.

20. The method of claim 14, further comprising operating an engine when the amount of fuel in the fuel tank is less than an amount of fuel required to fill the fuel tank.

21. An engine control assembly, comprising:

a fuel sensor configured to determine a fuel level;

a fluid sensor configured to determine a quantity of reductant on a vehicle;

a temperature sensor configured to determine a temperature in a cabin of a vehicle; and a controller operably coupled to the fuel sensor, fluid sensor, and temperature sensor, the controller being configured to operate an engine during an engine idle time calculated based on the fuel level and the quantity of reductant to maintain the temperature in the cabin.

22. The engine control assembly of claim 21, wherein the controller is configured to determine the engine idle time in response to the fuel level, the quantity of reductant, and the temperature in the cabin.

23. The engine control assembly of claim 21, further comprising at least one position sensor operably coupled to the controller and configured to determine at least one of: a transmission gear position and a position of a park brake of the vehicle, and the controller being configured to operate the engine in response to the at least one of: the transmission gear position and the position of the park brake.

* * * * *